United States Patent [19]

Dreybus

[11] 4,312,333

[45] Jan. 26, 1982

[54] TACTILE STIMULATING MECHANISM

[76] Inventor: Gail B. Dreybus, 123 James Landing Rd., Newport News, Va. 23606

[21] Appl. No.: 193,705

[22] Filed: Oct. 3, 1980

Related U.S. Application Data

[63] Continuation of Ser. No. 59,986, Jul. 23, 1979, abandoned.

[51] Int. Cl.[3] ..... A61H 7/00

[52] U.S. Cl. ..... 128/49

[58] Field of Search ..... 128/49, 44, 52, 55, 128/56, 62 R, 79

[56] References Cited

U.S. PATENT DOCUMENTS 3,799,155 3/1974 Gerlich ..... 128/44

3,978,851 9/1976 Sobel ..... 128/49

*Primary Examiner*—John D. Yasko

[57] ABSTRACT

This invention concerns a method of and means to achieve deep relaxation through extremely light tactile stimulation for the skin comprising a rack with filaments extending downwardly therefrom capable of being moved in more than one repetitive pattern and speed over the skin of the user.

8 Claims, 4 Drawing Figures

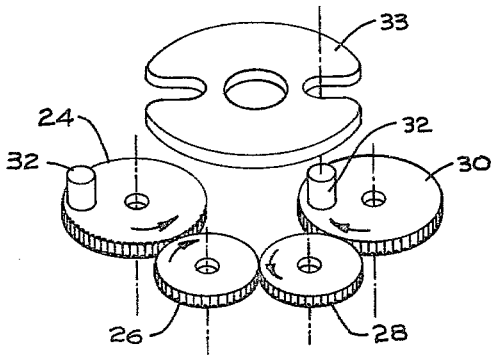
FIGURE 3
FIGURE 4
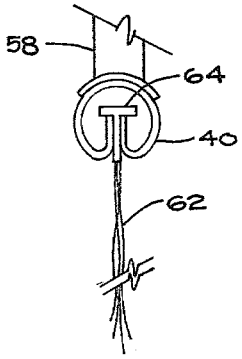
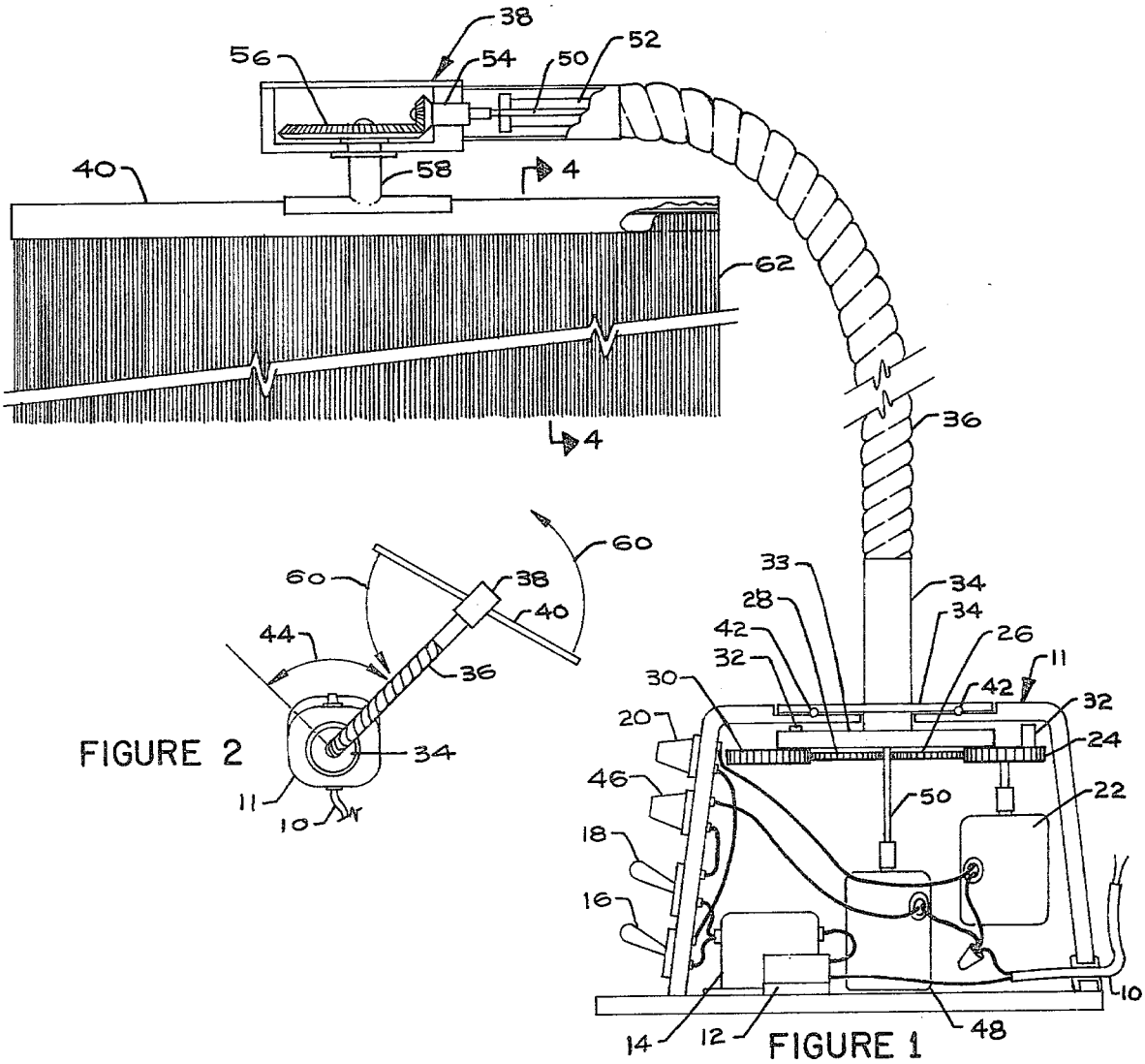
FIGURE 2
FIGURE 1

TACTILE STIMULATING MECHANISM

This appln. is a continuation of Ser. No. 58,986, July 23, 1979, abandoned.

BACKGROUND OF THE INENTION

This invention relates generally to a vibratory massage device and more particularly to a device whereby a person lying in a horizontal plane may position said device in such a manner as to receive light tactile stimulation or repetitive stroking therefrom on various parts of the body.

DESCRIPTION OF THE PRIOR ART

It is known that extremely light tactile stroking has been useful during natural childbirth procedures to lessen the impact of muscular contractions; it is further known that some relief from asthma attacks may be achieved from gently stroking the individual undergoing such attack in a repetitive pattern; it is further known that unrelieved physical and mental anxieties and tensions may result in severe illness, and that said anxieties may be relieved through various kinds of physical stimulation, such as deep pressure rubbing, vibration, or stroking techniques. Currently available devices achieve deep pressure relief such as that derived from vibration devices which move body tissue underlying the surface of the skin. My invention provides light, superficial stimulation such as that which is observable as a "gooseflesh" type reaction from light, gentle touch or stroking. This invention is based on anatomical and biological principles of tactile interruption of certain pressoreceptors which are located in the epidermal and dermal layers of the skin which relay biochemical "messages" to the autonomic nervous system. Underlying tissue are not usually affected by this tactile stimulating device; and that the said invention provides an alternate form of relief from those current devices which operate on deep pressure techniques.

SUMMARY OF THE INVENTION

The object of the invention, therefore, is to allow distraught, mentally and physically fatigued, or tense individuals to achieve a form of relief and relaxation.

A further object of the invention is to provide an inexpensive, simplistic, lightweight, portable apparatus to achieve this effect which can be set and adjusted by the individual user, and requires no special medical knowledge.

A further object of the invention is to allow for individualization of relif by interchangeable filaments of varying weights and constitution; to provide for individualization by variable motion and speed of components in a regular pattern; and to provide for individualization by adjustability to body size and by adjustability to either a prone or a sitting position.

A further object of the invention is to provide an alternate form of relaxing physical contact which is different from deep pressure techniques.

The foregoing and other objectives may be accomplished by providing a base with motor or motors and gear train therein; a flexible support arm containing flexible shaft; and a head with attached brush apparatus comprised of a rack and interchangeable filaments, bristles or material suitable for a light stroking sensation.

BRIEF DESCRIPTION OF THE DRAWINGS

The above and various and other objectives and advantages will be apparent from the following description and claim and from the accompanying drawings, wherein In said drawings:

FIG. 1 is a perspective view in cross-section of the invention showing the base with motor control units, drive system, shaft, head, and arm with attached filament rack.

FIG. 2 is a top plan view of FIG. 1 with arrows to designate arcuate motion of the shaft and circular motion of the arm.

FIG. 3 is an exploded view illustrating the drive train.

FIG. 4 is a section on line 4—4 of FIG. 1.

DESCRIPTION OF THE PREFERRED EMBODIMENTS

Referring in more detail to the drawings and particularly to FIG. 1, there is shown a base 11 which provides housing for the motors and gear train, and which is constructed of cast iron or other suitable material capable of providing sufficient structure and strength to support the mechanism, and sufficient weight to stabilize said device. Said motors being the power means to energize two motions of the invention to be hereinafter described in more detail. Ball bearings 42 are located in the upper portion of base 11 in circular grooving of base 11 and arm base 34 to allow for a smooth arcuate motion of the entire arm assembly comprised of arm base 34, bendable support shaft 36, gearhead casing 38, and revolvable filament arm 40. Bendable support shaft 36 is constructed of sturdy, flexible aluminum alloy, or of such other suitable material as will allow for adjustability and positioning of stroking filaments to operate above and over a person's body while in a horizontal position, or to allow for a vertical position so as to stroke an individual seeking relief who must sit in a chair to be relieved.

Gearhead casing 38 provides the housing for bevel gear assembly consisting of gear 54 in mesh with gear 56 which serve to rotate filament arm 40 which is mounted on connecting shaft 58.

FIG. 4 illustrates in more detail filament arm 40 which contains sliding removable rack 64 and replaceable filaments 62. Material for filaments may range from fine feather bristles to stiff strawlike materials, or such other fabric or substance which will serve to lightly stimulate, stroke, or otherwise interrupt the neuroreceptors located in the skin.

Internal operation proceeds with alternating current entering through electrical cord 10 to rectifier bridge 12. Stepdown transformer 14 feeds direct current into two on-off switches 16 and 18 leading to power motors 22 and 48. The speed of hereinafter described arcuate and rotational motions are regulated by rheostat switches 20 and 46 controlling the power to same when switches 16 and 18 are in the "on" position.

Power is transmitted from motor 22 to turn gears 24, 26, 28, and 30 as shown more explicitly in FIG. 3. Gears 24 and 30 counter-rotate and have pins 32, that alternately slide into slots on geneva gear 33 causing an arcuate turn first to the left and then to the right for a total arcuate motion of approximately 90° as shown by arrows 44 of FIG. 2, or such other arc as is sufficient to cause the entire arm asembly 34, 36, 38 and 40 to sweep back and forth in an oscillating fan type motion; said arm assembly being journalled in geneva gear 33 by arm base 34. Power is transmitted from motor 48 which turns cable 50 housed in stationary casing 52 located within bendable support shaft 36. Rotating cable 50 connects to bevel gear 54 which turns gear 56 causing a 360° rotation of attached connecting shaft 58 and filament arm 40, as shown by arrows 60 of FIG. 2.

FIG. 2 more explicitly illustrates the dual mobility of the invention. Filament arm 40 containing interchangeable filaments 62 of FIG. 1 makes a complete 360° rotational turn at an adjustable speed while bendable support shaft 36 simultaneously sweeps across the skin of the user in an arcuate back and forth oscillating fan-type motion.

Off-on switches 16 and 18 allow for the termination of one or both motions at the option of the user. Rheostat switches 20 and 46 allow for variable speeds of rotation and arc depending on the preference of the user.

It should be noted that for anatomic reasons it is necessary to allow for such termination and variable speeds. Once nerve endings have fired for a period of time, if sustaining repetitive motions continue, a patient would experience a burning sensation. Nerves, once fired repetively in the same path over time, experience abrasion. When this occurs, the sensation of "tickling" or "scratching" no longer continues, and relief does not occur.

Although most patients achieve best results while relaxing in a prone position, it is sometimes necessary to administer touch stimulation while sitting in a chair. It may be noted that with bendable support shaft 36 in a vertical position and motor 48 only to the "on" position, and filaments 62 of a stiff type constituency, the user may also assume a sitting position for said tactile stimulation.

The above described embodiments of my device are preferred forms and what I desire to secure by Letters Patent is defined in the following claim:

1. A portable tactile stimulating massage apparatus comprised of:

a shaft containing flexible filaments depending downwardly therefrom;

a means of support or arm for said shaft capable of causing motion of said filaments in a continuous circular pattern;

a flexible, bendable shaft connected thereto capable of simultaneous arcuate motion in a continuous pattern;

power means for moving said filaments in abovementioned circular and arcuate motions;

housing base for said power means of sufficient structure to stabilize said apparatus on any flat surface.

2. A tactile stimulating massage apparatus as claimed in claim 1 whereby said flexible filaments are comprised of a featherlike constituency.

3. A tactile stimulating apparatus as claimed in claim 1 whereby said flexible filaments are of a plasticlike scratching constituency.

4. A tactile stimulating apparatus as claimed in claim 1 whereby said flexible filaments are removeable and interchangeable.

5. A tactile stimulating apparatus as claimed in claim 1 whereby said flexible, bendable shaft is made of a material capable of retaining its position when positioned over a body to be massaged.

6. A tactile stimulating apparatus as claimed in claim 1 whereby said flexible, bendable shaft is made of material capable of retaining its position when positioned upright so as to massage a patient while in a sitting position.

7. A tactile stimulating apparatus as claimed in claim 1 whereby said power means requires two separate and distinct power sources.

8. A tactile stimulating apparatus as claimed in claim 1 whereby said power means for both motions is incorporated into one unit capable of causing both circular and arcuate motions of the device.

* * * * *